US010620583B2

(12) United States Patent
Nemoto

(10) Patent No.: US 10,620,583 B2
(45) Date of Patent: Apr. 14, 2020

(54) IMAGE FORMING APPARATUS AND METHOD

(71) Applicant: CANON KABUSHIKI KAISHA, Tokyo (JP)

(72) Inventor: Yusuke Nemoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/436,441

(22) Filed: Jun. 10, 2019

(65) Prior Publication Data

US 2019/0384220 A1 Dec. 19, 2019

(30) Foreign Application Priority Data

Jun. 18, 2018 (JP) ..... 2018-115169

(51) Int. Cl.
*G03G 21/20* (2006.01)
*G03G 15/04* (2006.01)

(52) U.S. Cl.
CPC ..... *G03G 21/203* (2013.01); *G03G 15/04* (2013.01)

(58) Field of Classification Search
CPC ..... G03G 21/203; G03G 15/04
See application file for complete search history.

(56) References Cited

U.S. PATENT DOCUMENTS

| | | | | |
|---|---|---|---|---|
| 8,203,586 | B2 | 6/2012 | Kaneko et al. | 347/241 |
| 10,180,658 | B2 * | 1/2019 | Tomiyasu | G03G 21/0005 |
| 2017/0257511 | A1 * | 9/2017 | Matsui | G03G 15/50 |
| 2018/0164728 | A1 * | 6/2018 | Mandachi | B41J 29/377 |

FOREIGN PATENT DOCUMENTS

| | | |
|---|---|---|
| JP | 2005-321507 | 11/2005 |

* cited by examiner

*Primary Examiner* — Gregory H Curran
(74) *Attorney, Agent, or Firm* — Venable LLP

(57) ABSTRACT

An image forming apparatus calculates a dew point temperature from an outside air temperature, and determines whether a temperature near an optical unit is equal to or lower than the dew point temperature. In a case where the temperature near the optical unit is equal to or lower than the dew point temperature, the image forming apparatus determines that a condition of occurrence of dew condensation on a surface of a dustproof glass of the optical unit is satisfied or not, and displays a message on an operation display unit instructing a user to clean the surface of the dustproof glass using a cleaning tool.

14 Claims, 7 Drawing Sheets

| | | HUMIDITY [%] | | | | | | | |
|---|---|---|---|---|---|---|---|---|---|
| | | 20 | 30 | 40 | 50 | 60 | 70 | 80 | 90 |
| TEMPERATURE [°C] | 5 | ~~16.2~~ | ~~11.2~~ | ~~7.5~~ | -4.6 | -2.1 | 0.0 | 1.8 | 3.5 |
| | 6 | -15.4 | -10.3 | -6.6 | -3.6 | -1.2 | 1.0 | 2.8 | 4.5 |
| | 7 | -14.5 | -9.4 | -5.7 | -2.7 | -0.2 | 1.9 | 3.8 | 5.5 |
| | 8 | -13.7 | -8.5 | -4.8 | -1.8 | 0.7 | 2.9 | 4.8 | 6.5 |
| | 9 | -12.8 | -7.7 | -3.9 | -0.8 | 1.7 | 3.9 | 5.8 | 7.5 |
| | 10 | -12.0 | -6.8 | -2.9 | 0.1 | 2.6 | 4.8 | 6.7 | 8.4 |
| | 11 | -11.1 | -5.9 | -2.0 | 1.0 | 3.6 | 5.8 | 7.7 | 9.4 |
| | 12 | -10.3 | -5.0 | -1.1 | 2.0 | 4.5 | 6.7 | 8.7 | 10.4 |
| | 13 | -9.4 | -4.1 | -0.2 | 2.9 | 5.5 | 7.7 | 9.7 | 11.4 |
| | 14 | -8.6 | -3.2 | 0.7 | 3.8 | 6.4 | 8.7 | 10.6 | 12.4 |
| | 15 | -7.7 | -2.4 | 1.6 | 4.7 | 7.4 | 9.6 | 11.6 | 13.4 |
| | 16 | -6.9 | -1.5 | 2.5 | 5.7 | 8.3 | 10.6 | 12.6 | 14.4 |
| | 17 | -6.0 | -0.6 | 3.4 | 6.6 | 9.3 | 11.6 | 13.6 | 15.4 |
| | 18 | -5.2 | 0.3 | 4.3 | 7.5 | 10.2 | 12.5 | 14.5 | 16.4 |
| | 19 | -4.3 | 1.2 | 5.2 | 8.5 | 11.2 | 13.5 | 15.5 | 17.3 |
| | 20 | -3.5 | 2.1 | 6.1 | 9.4 | 12.1 | 14.4 | 16.5 | 18.3 |
| | 21 | -2.6 | 2.9 | 7.1 | 10.3 | 13.1 | 15.4 | 17.5 | 19.3 |
| | 22 | -1.8 | 3.8 | 8.0 | 11.3 | 14.0 | 16.4 | 18.5 | 20.3 |
| | 23 | -1.0 | 4.7 | 8.9 | 12.2 | 15.0 | 17.3 | 19.4 | 21.3 |
| | 24 | -0.1 | 5.6 | 9.8 | 13.1 | 15.9 | 18.3 | 20.4 | 22.3 |
| | 25 | ~~0.7~~ | ~~6.5~~ | ~~10.7~~ | 14.0 | 16.8 | 19.3 | 21.4 | 23.3 |
| | 26 | 1.6 | 7.3 | 11.6 | 15.0 | 17.8 | 20.2 | 22.4 | 24.3 |
| | 27 | 2.4 | 8.2 | 12.5 | 15.9 | 18.7 | 21.2 | 23.3 | 25.3 |
| | 28 | 3.3 | 9.1 | 13.4 | 16.8 | 19.7 | 22.1 | 24.3 | 26.2 |
| | 29 | 4.1 | 10.0 | 14.3 | 17.7 | 20.6 | 23.1 | 25.3 | 27.2 |

FIG. 5

GLASS INSIDE THE APPARATUS IS DEW-CONDENSED AND IMAGE MAY BE DISTORTED SO THAT PRINTING IS PROHIBITED.

RECOVERY OPERATION IS CURRENTLY BEING PERFORMED. PLEASE WAIT A WHILE MORE.

FIG. 8A

RECOVERY OPERATION IS COMPLETED.

PLEASE OPEN A FRONT DOOR, WIPE THE GLASS INSIDE THE APPARATUS USING THE CLEANING TOOL AND THEN, CLOSE THE FRONT DOOR.

PLEASE PRESS "OPERATION COMPLETION" WHEN THE OPERATION IS COMPLETED.

OPERATION COMPLETION

FIG. 8B

IMAGE FORMING APPARATUS AND METHOD

BACKGROUND OF THE INVENTION

Field of the Invention

The present invention relates to an image forming apparatus such as an electrophotographic type, an electrostatic recording type, and the like. The image forming apparatus performs image formation with use of laser light.

Description of the Related Art

In the image forming apparatus, image formation is performed, for example, by forming an electrostatic latent image on a photosensitive member by irradiating the photosensitive member with the laser light, developing the electrostatic latent image by a developer such as a toner to form a developer image (toner image), and transferring the toner image to a sheet. Adhesion of deposits of dirt, dust, and the like due to the toner, paper dust, and the like to an optical unit which irradiates the laser light deteriorates the quality of an image to be formed. Thus, the optical unit is configured to prevent intrusion of deposits by sealing and housing light source of the laser light and its components such as a lens. In this case, the optical unit is provided with a laser emission port. The laser emission port is covered with a dustproof glass. In this configuration, however, due to the adhesion of the deposits to the surface of the dustproof glass, the laser light may be scattered or blocked, which sometimes causes abnormality in the image to be formed.

For this reason, a method for cleaning the deposits adhered to the surface of the dustproof glass by a cleaning member is proposed (Japanese Patent Application Laid-Open No. 2005-321507). Further, a method for cleaning the surface of the dustproof glass by moving the cleaning member along with inserting and extracting operation of a cartridge member which can be inserted into and extracted from the image forming apparatus is proposed (U.S. Pat. No. 8,203,586 B2). In these methods, by removing the deposits adhered to the surface of the dustproof glass by the cleaning member, an occurrence of the abnormal image is prevented.

In addition to the adhesion of the deposits to the surface of the dustproof glass, cause of the abnormal image includes, for example, dew condensation of the surface of the dustproof glass due to a change of an outside air temperature of the image forming apparatus. In a case where it is the deposits that are the cause of the abnormal image, if the surface of the dustproof glass is once cleaned, the cleaning is not required for a predetermined period thereafter. However, the dew condensation on the surface of the dustproof glass may occur at any time if a temperature condition and a humidity condition of an installation environment of the image forming apparatus are satisfied. It is difficult for a user to know in advance that the surface of the dustproof glass needs to be cleaned due to the dew condensation on the surface of the dustproof glass, and the user understands that it is necessary to clean the surface of the dustproof glass when the imaging abnormality occurs. In a case where the imaging abnormality occurs, resources such as the sheets, the toner, and the like used for the image formation are wastefully consumed. The main object of the present disclosure is to provide an image forming apparatus capable of preventing the occurrence of the abnormal image due to the dew condensation of the dustproof glass of the optical unit.

SUMMARY OF THE INVENTION

An image forming apparatus according to the present disclosure includes: a photosensitive member; an optical unit, having a light source, configured to form an image on the photosensitive member by irradiating the photosensitive member with light emitted from the light source; a light transmitting member through which the light from the optical unit is irradiated to the photosensitive member; a cleaning member configured to clean a surface of the light transmitting member; a determination unit configured to determine whether a condition of occurrence of dew condensation of the light transmitting member is satisfied or not; and a control unit configured to display a message on a display unit instructing to clean the light transmitting member with use of the cleaning member in a case where it is determined, by the determination unit, that the condition of occurrence of dew condensation of the light transmitting member is satisfied.

Further features of the present invention will become apparent from the following description of exemplary embodiments (with reference to the attached drawings).

BRIEF DESCRIPTION OF THE DRAWINGS

FIG. 5 is an explanatory diagram of the dew point temperature.

FIG. 8A and FIG. 8B are diagrams each illustrating a message.

DESCRIPTION OF THE EMBODIMENTS

Hereinafter, embodiments will be described in detail with reference to the drawings.

Image Forming Apparatus

Figure 1:
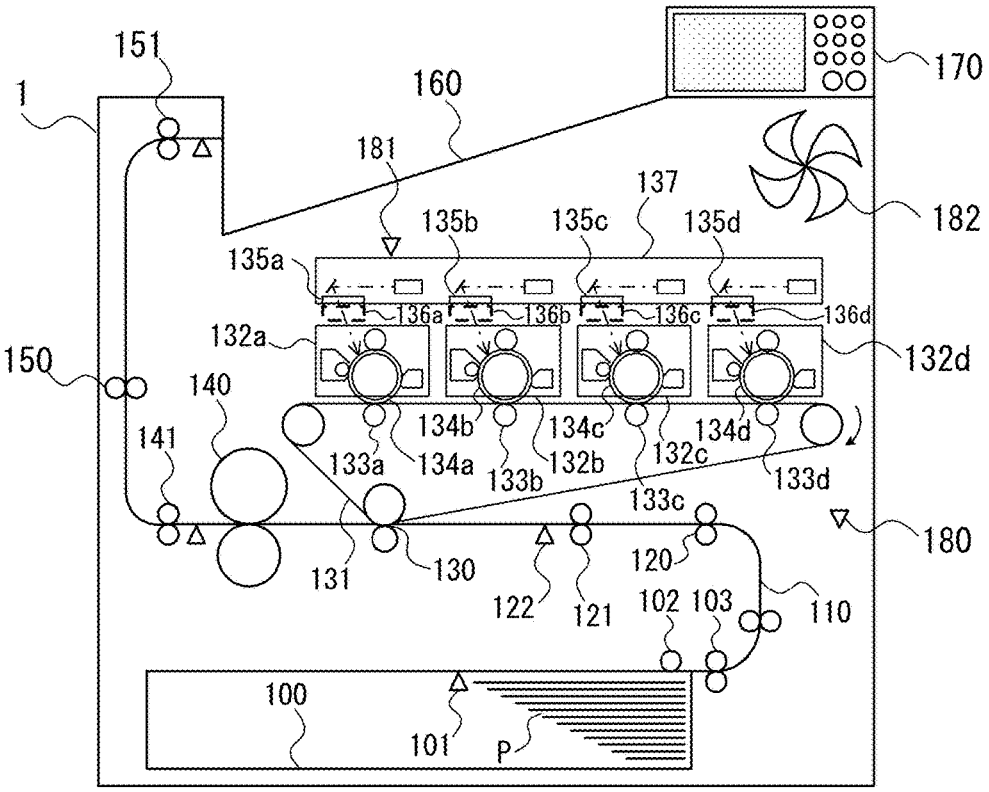
FIG. 1 is a schematic configuration diagram of an image forming apparatus.

FIG. 1 is a schematic configuration diagram of an image forming apparatus according to the present embodiment. An image forming apparatus 1 includes four image forming parts 132*a* to 132*d* corresponding to four colors of yellow, cyan, magenta and black. The image forming parts 132*a* to 132*d* are cartridge members. The image forming parts 132*a* to 132*d* can be inserted to and extracted from the image forming apparatus 1. The image forming part 132*a* forms an image of yellow. The image forming part 132*b* forms an image of magenta. The image forming part 132*c* forms an image of cyan. The image forming part 132*d* forms an image of black.

The image forming parts 132*a* to 132*d* are provided with photosensitive drums 134*a* to 134*d* which are drum-like photosensitive members. The image forming parts 132*a* to 132*d* form toner images on the photosensitive drums 134*a* to 134*d* by each step of charging, exposure, and development. A yellow toner image is formed on the photosensitive drum 134*a*. A magenta toner image is formed on the photosensitive drum 134*b*. A cyan toner image is formed on the photosensitive drum 134*c*. A black toner image is formed on the photosensitive drum 134*d*. An optical unit 137 is provided on top of the image forming parts 132*a* to 132*d*. The optical unit 137 is used for the exposure step of the photosensitive drums 134*a* to 134*d*.

The image forming apparatus 1 includes an intermediate transfer belt 131 as an intermediate transfer body for transferring the toner image formed in the image forming parts 132*a* to 132*d* to a sheet. The intermediate transfer belt 131 is provided at a lower part of the photosensitive drums 134*a* to 134*d*. Primary transfer parts 133*a* to 133*d* are provided at positions respectively opposite to the photosensitive drums 134*a* to 134*d* with the intermediate transfer belt 131 interposed therebetween. The toner images formed on each of the photosensitive drums 134*a* to 134*d* are transferred to the intermediate transfer belt 131 by the primary transfer parts 133*a* to 133*d*. The intermediate transfer belt 131 is a belt member which is wound around a plurality of rollers, and rotates in a clockwise direction in the drawing. The toner images of the photosensitive drums 134*a* to 134*d* are superimposingly transferred to the intermediate transfer belt 131 at a timing corresponding to the rotation. Thus, a full-color toner image is formed on the intermediate transfer belt 131. The intermediate transfer belt 131 conveys the transferred toner image to a second transfer part 130 by the rotation.

The image forming apparatus 1 includes a sheet feeding cassette 100 and a conveying path 110 for feeding a sheet P on which an image is to be formed. Various rollers for feeding the sheet P from the sheet feeding cassette 100 to convey the sheet P are provided in the conveying path 110. The sheet P is conveyed to a sheet discharge tray 160 via the second transfer part 130 by the conveying path 110. The sheet feeding cassette 100 includes a sheet sensor 101 for detecting presence or absence of the sheet P. A pickup roller 102, a cassette feed/retard roller 103, a conveying roller 120, a registration roller 121, a conveying roller 141, a vertical path roller 150, and a paper discharge roller 151 are provided in the conveying path 110. The second transfer part 130 is provided on a downstream side in a conveying direction of the sheet P relative to the registration roller 121. A fixing device 140 is provided on a downstream side in a conveying direction of the sheet P relative to the second transfer unit 130. A registration sensor 122 is provided between the registration roller 121 and the second transfer part 130.

The sheet P is fed from the sheet feeding cassette 100 by the pickup roller 102. The sheet P fed from the sheet feeding cassette 100 is conveyed to the registration roller 121 one by one by the cassette feed/retard roller 103 and the conveying roller 120. The registration roller 121 performs skew correction of the sheet P. The registration roller 121 conveys the sheet P to the second transfer part 130 according to the timing at which the toner image formed on the intermediate transfer belt 131 is conveyed to the second transfer part 130. The registration sensor 122 detects the sheet P which is conveyed to the second transfer part 130.

The second transfer part 130 transfers the toner image formed on the intermediate transfer belt 131 to the sheet P. The sheet P having the toner image transferred thereto is conveyed to the fixing device 140. The fixing device 140 fixes the image on the sheet P by, for example, heating and pressurizing the sheet P having the toner image transferred thereto. The sheet P having the image fixed thereon is conveyed to the sheet discharge roller 151 by the conveying roller 141 and the vertical path roller 150. The sheet discharge roller 151 discharges the sheet P to the sheet discharge tray 160.

The image forming apparatus 1 includes an operation display part 170, a temperature and humidity sensor 180, an optical unit temperature sensor 181, and a fan 182. The operation display part 170 comprises an operation part (input part) for inputting operation information from the user and a display part (output part) for displaying print information and an instruction, warning, and the like to the user. The temperature and humidity sensor 180 performs temperature detection and humidity detection of the outside air of the image forming apparatus 1. The optical unit temperature sensor 181 performs ambient temperature detection of the optical unit 137. The fan 182 sucks the outside air inside the image forming apparatus 1 at the time of driving.

Hereinafter, the optical unit 137 will be described. The optical unit 137 is provided with a laser scanner (optical scanning part) corresponding to each color. Each laser scanner has a light source for irradiating the photosensitive drums 134*a* to 134*d* with the laser light corresponding to the image information representing the image to be formed. The surfaces of the photosensitive drums 134*a* to 134*d* are exposed by the laser light. Thus, the electrostatic latent images corresponding to the image information are formed on the surfaces of the photosensitive drums 134*a* to 134*d*. In the optical unit 137, portions for emitting the laser light to the photosensitive drums 134*a* to 134*d* (emission ports) are formed corresponding to each of the photosensitive drums 134*a* to 134*d*. Each emission port is sealed with a light transmitting member to which light is transmitted. In the present embodiment, dustproof glasses 135*a* to 135*d* are used as the light transmitting member. Cleaning openings 136*a* to 136*d* which are open during the cleaning of the dustproof glasses 135*a* to 135*d* are provided on a lower side of the optical unit 137.

Controller

Figure 2:
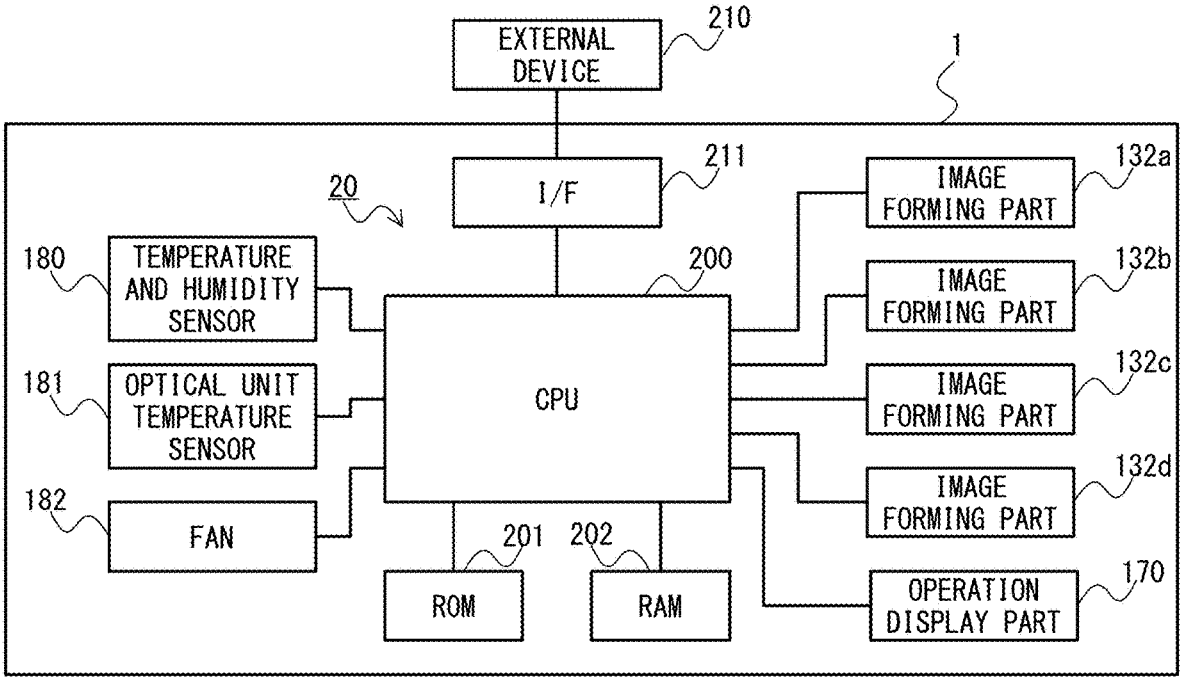
FIG. 2 is an explanatory diagram of a controller.

FIG. 2 is an explanatory diagram of a controller which controls the operation of the image forming apparatus 1. The controller 20 includes a central processing unit (CPU) 200, a read only memory (ROM) 201, a random access memory (RAM) 202, and an interface (I/F) 211. The I/F 211 is a communication interface for communicating with an external device 210 such as a personal computer and the like. The I/F 211 obtains the print information including the instruction to form the image from the external device 210. The print information includes, for example, the image information as described above. The controller 20 is incorporated in the image forming apparatus 1.

The CPU 200 controls the operation of the image forming apparatus 1 by executing a control program stored in the ROM 201 by using the RAM 202 as a working area. The CPU 200 performs image formation by controlling the operation of the image forming parts 132*a* to 132*d*, the optical unit 137, and the like according to the print information obtained from the external device 210. The CPU 200 obtains the operation information by the user from the operation display part 170. The CPU 200 causes the operation display part 170 to display the print information and a message such as an instruction and warning. The CPU 200 obtains information on the temperature (outside air temperature) and the humidity (outside air humidity) of the image forming apparatus 1 from the temperature and humidity sensor 180. The CPU 200 obtains information on the temperature (ambient temperature) near the optical unit 137 from the optical unit temperature sensor 181. The CPU 200 drives to control the fan 182 to take the outside air into the image forming apparatus 1. By driving the fan 182, an internal temperature of the image forming apparatus 1, for example, the ambient temperature of the optical unit 137 decreases.

Operation of Image Forming Apparatus

Operation during the image formation by the image forming apparatus 1 with the configuration as described above will be described. The CPU 200 starts the image formation on the sheet P by obtaining the print information from the external device 210. The CPU 200 stores the obtained print information in the RAM 202 and uses the information for the image formation.

When the image formation is started, the CPU 200 feeds the sheet P from the sheet feeding cassette 100 to the conveying path 110 by the pickup roller 102. The fed sheet P is conveyed one by one on the conveying path 110 by the cassette feed/retard roller 103. The sheet P is conveyed to the registration roller 121 via the conveying roller 120 along the conveying path 110. The registration roller 121 performs the skew correction of the sheet P and stops the conveyance of the sheet P up to predetermined timing. It is noted that the CPU 200 detects the presence or absence of the sheet P in the sheet feeding cassette 100 by the sheet sensor 101.

In parallel to the conveyance of the sheet P, the CPU 200 forms the toner images of each color on the photosensitive drums 134*a* to 134*d* by the image forming parts 132*a* to 132*d* and the optical unit 137. The toner image is formed as follows. The CPU 200 charges the surface of the photosensitive drums 134*a* to 134*d* of the image forming parts 132*a* to 132*d* on which the toner images are to be formed. The CPU 200 emits the laser light from the light source of the optical unit 137. The emitted laser light passes through the dustproof glasses 135*a* to 135*d* and irradiates the charged surfaces of the photosensitive drums 134*a* to 134*d*. Thus, the electrostatic latent images are formed on the photosensitive drums 134*a* to 134*d*. The electrostatic latent image is developed into the toner image by the toner (developer). The toner images formed on the photosensitive drums 134*a* to 134*d* are transferred to the intermediate transfer belt 131 by the primary transfer parts 133*a* to 133*d*. The toner image transferred to the intermediate transfer belt 131 is conveyed to the second transfer part 130 by the rotation of the intermediate transfer belt 131.

The CPU 200 causes the registration roller 121 to resume the conveyance of the sheet P according to a timing at which the toner image transferred to the intermediate transfer belt 131 is conveyed to the second transfer part 130. The CPU 200 monitors the registration sensor 122 and determines whether the sheet P is properly fed from the sheet feeding cassette 100 or not. The CPU 200 transfers the toner image from the intermediate transfer belt 131 to the sheet P by the second transfer part 130. The sheet P is conveyed from the second transfer part 130 to the fixing device 140. The fixing device 140 fixes the toner image on the sheet P. Thus, the image formation on the sheet P is completed. The CPU 200 conveys the sheet P after the image formation by the conveying roller 141, the vertical path roller 150 and the sheet discharge roller 151. The sheet P is discharged to the sheet discharge tray 160 with the printed side facing downward.

Cleaning of Dustproof Glasses 135*a* to 135*d*

Figure 3A:
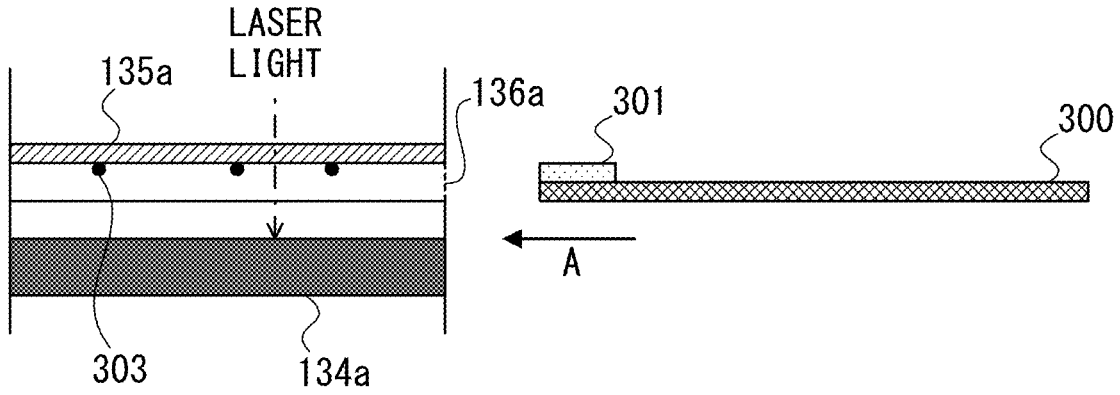
FIG. 3A, FIG. 3B, and FIG. 3C are diagrams each explaining a cleaning procedure of the surface of the dustproof glass.
Figure 3B:
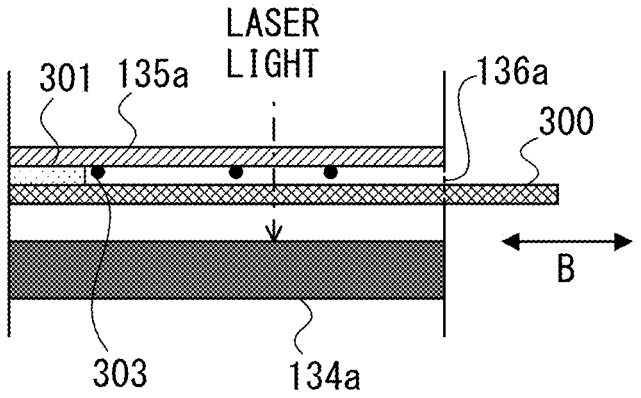
Figure 3C:
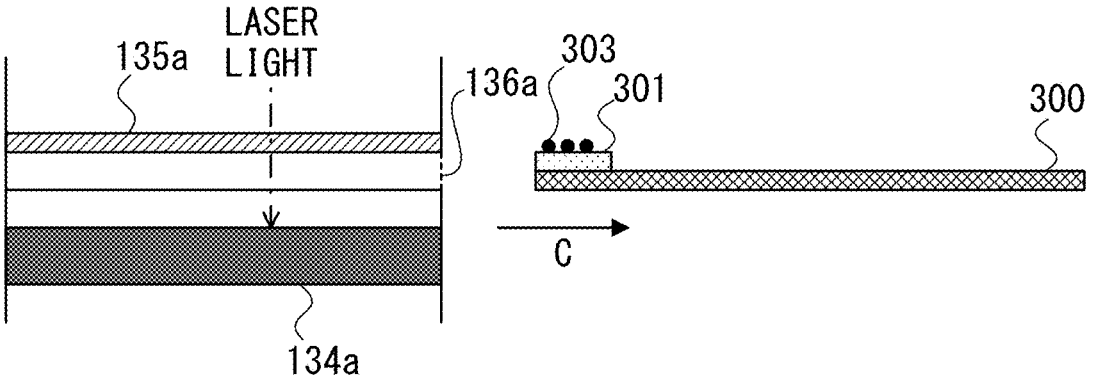

FIG. 3A to FIG. 3C are explanatory diagrams of a cleaning procedure of the surfaces of the dustproof glasses 135*a* to 135*d* of the optical unit 137. Here, a case of cleaning the surface of the dustproof glass 135*a* will be described. The cleaning of the dustproof glasses 135*b* to 135*d* is similarly performed. Dirt and dust of the toner, the paper dust, and the like float inside the image forming apparatus 1. The dirt and the dust may adhere to the surface of the dustproof glass 135*a* and become deposit 303. Due to the deposit 303, a path of the laser light irradiated from the optical unit 137 to the photosensitive drum 134*a* is blocked. As a result, there is a possibility that the abnormal image may occur. Thus, the cleaning of the dustproof glass 135*a* is required.

The cleaning of the dustproof glass 135*a* is performed by a cleaning tool 300. The cleaning tool 300 is a cleaning member dedicated to clean the surface of the dustproof glass 135*a*. The cleaning tool 300 is attached to the image forming apparatus 1. The cleaning tool 300 includes a cleaning pad 301 at a tip of the cleaning tool 300. The cleaning pad 301 is used to remove the deposit 303 (dirt) of the surface of the dustproof glass 135*a*. By removing the deposit 303 adhered to the surface of the dustproof glass 135*a* using the cleaning tool 300, an occurrence of the abnormal image can be prevented.

The cleaning of the dustproof glass 135*a* is started when the user opens a door (not shown) provided on a front surface of the image forming apparatus 1 to expose the cleaning opening 136*a* (FIG. 3A). The user inserts the cleaning tool 300 in an arrow A direction from the cleaning opening 136*a*. By inserting and extracting the cleaning tool 300 in an arrow B direction, the user scrapes the deposit 303 (FIG. 3B). The user pulls out the cleaning tool 300 in an arrow C direction (FIG. 3C). With the above procedure, the cleaning of the surface of the dustproof glass 135*a* using the cleaning tool 300 is completed.

Dew Condensation of Dustproof Glasses 135*a* to 135*d*

Figure 4:
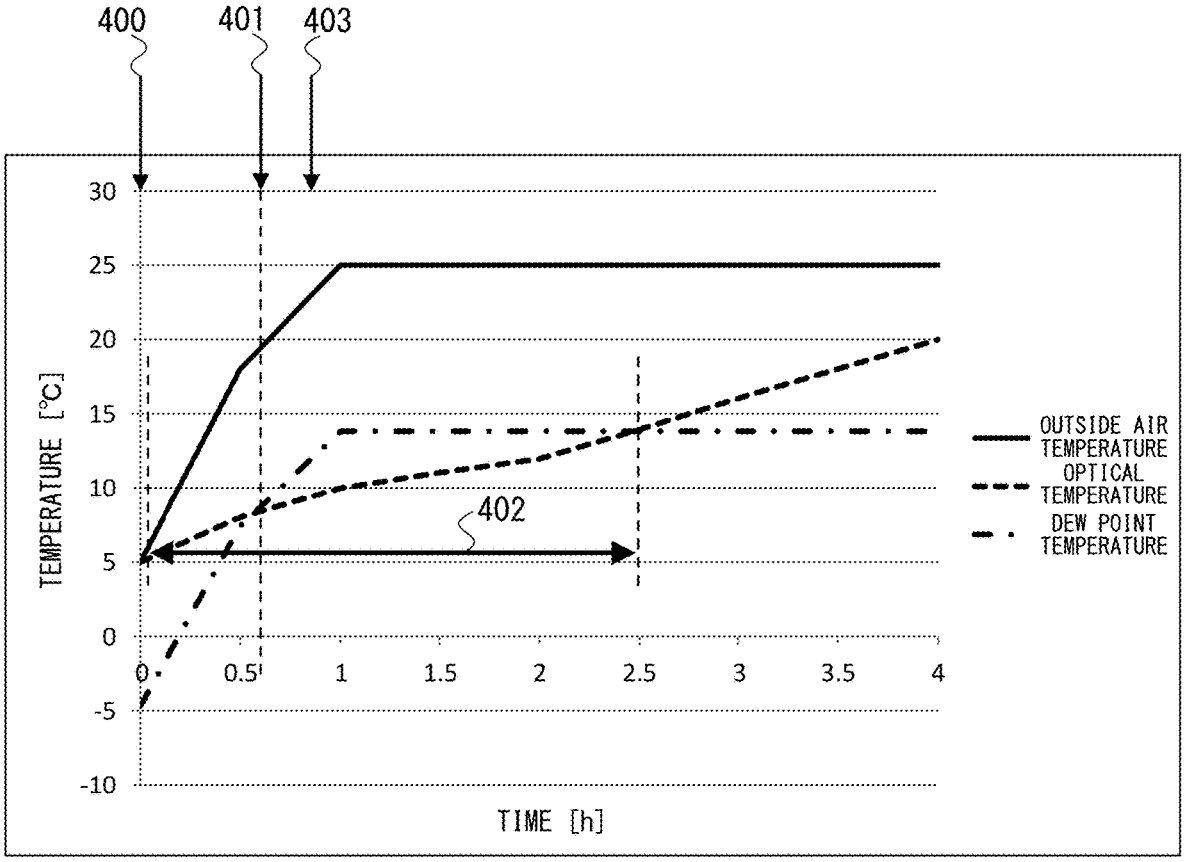
FIG. 4 is a graph illustrating a transition of the outside air temperature, an optical temperature, and a dew point temperature.

FIG. 4 is a graph illustrating transitions of the outside air temperature of the image forming apparatus 1, the ambient temperature of the optical unit 137 (hereinafter referred to as "optical temperature"), and the dew point temperature in the installation environment of the image forming apparatus 1. The outside air temperature is detected by the temperature and humidity sensor 180. The optical temperature is detected by the optical unit temperature sensor 181. The outside air temperature is represented by a solid line. The optical temperature is represented by a dashed line. The dew point temperature is represented by a single dotted line.

FIG. 5 is an explanatory diagram of the dew point temperature. FIG. 5 is a dew point temperature table showing a dew point temperature determined from a relation of the temperature and the humidity. The dew point temperature is a temperature at which water vapor in air solidifies. For example, when the outside air temperature of the image forming apparatus 1 is 25° C. and the outside air humidity is 50%, according to the table in FIG. 5, the dew point temperature is 14° C. This means that if the temperature of an object is less than 14° C. in this environment, the dew condensation occurs on the object. The data in the dew point temperature table is stored in advance, for example, in the ROM 201. The CPU 200 can obtain the dew point temperature according to a detection result of the temperature and humidity sensor 180 and the dew point temperature table stored in the ROM 201.

For example, at timing 400 in FIG. 4, both the outside air temperature and the optical temperature are 5° C. As shown in the table in FIG. 5, if the outside air humidity is 50%, the dew point temperature at this time is −4.6° C. In this case, since the optical temperature is higher than the dew point temperature, the dew condensation does not occur on the surfaces of the dustproof glasses 135*a* to 135*d*.

In FIG. 4, the outside air temperature increases from 5° C. to 25° C. from the timing 400 to timing 401 which is one hour after the timing 400. The outside air temperature increases due to start of heating of room in winter and the like. In this case, the optical temperature increases slowly with respect to an increase in the outside air temperature. If the outside air temperature increases in this manner, the optical temperature becomes lower than the dew point temperature in a section 402. It means that, it is highly possible that the dew condensation occurs on the surfaces of the dustproof glasses 135*a* to 135*d* in the section 402. If the image formation is started at timing 403 during the section 402, the path of the laser light is blocked due to the dew condensation caused on the surfaces of the dustproof glasses 135*a* to 135*d* as in the case of the adhesion of the deposit 303. This may result in the occurrence of the abnormal image in the image to be formed. In this embodiment, the occurrence of the abnormal image is prevented by instructing the user to clean the dustproof glasses 135*a* to 135*d* when such a state occurs.

Image Forming Processing

Figure 6:
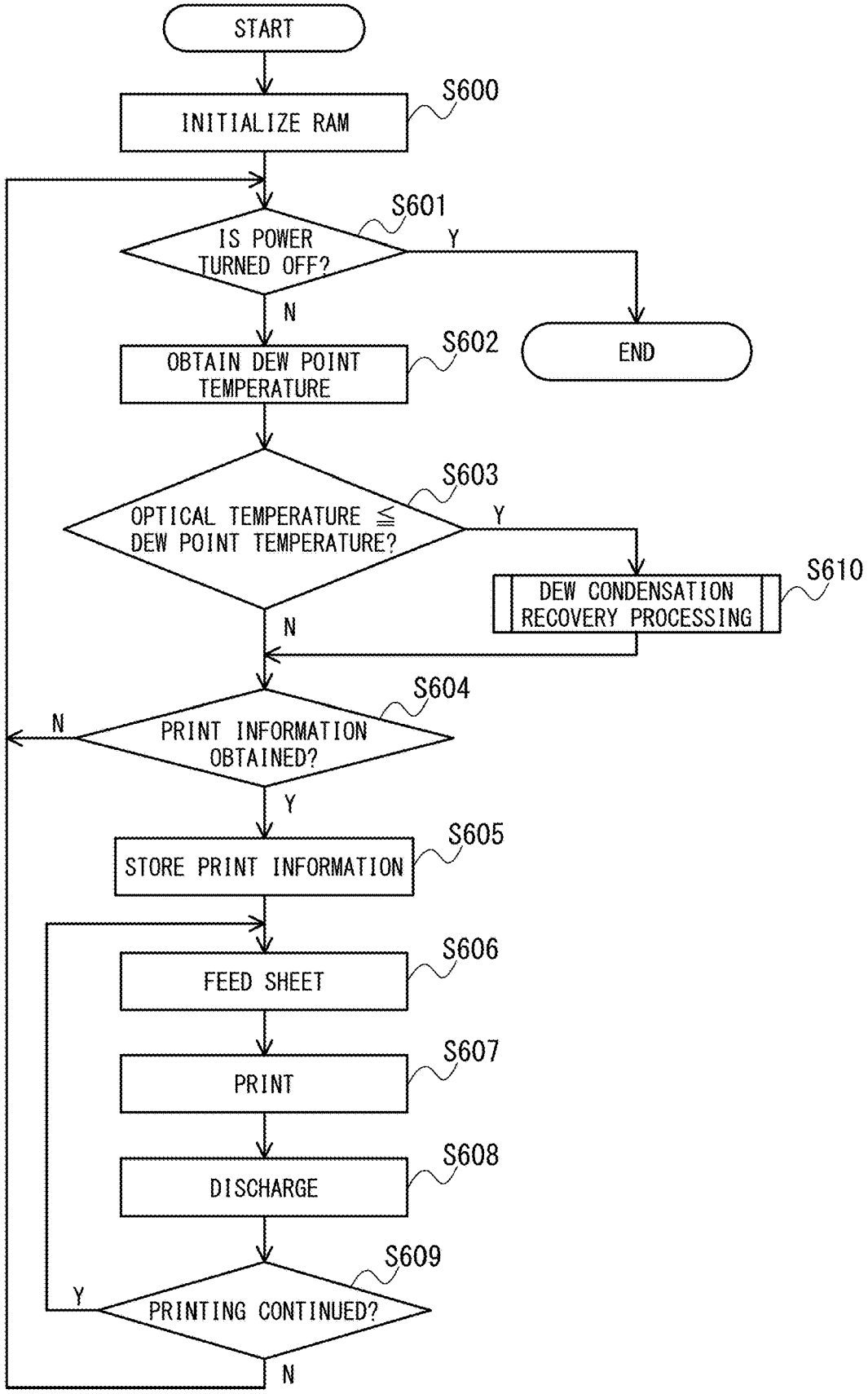
FIG. 6 is a flow chart showing image forming processing.

FIG. 6 is a flow chart showing image forming processing by the image forming apparatus 1. The CPU 200 starts the processing when the user turns on a power switch (not shown) to start the image forming apparatus 1.

The CPU 200 initializes the RAM 202 when the image forming apparatus 1 is started (Step S600). The CPU 200 confirms whether the power switch is turned off by the user or not (Step S601). If it is confirmed that the power switch is turned off (Step S601: Y), the CPU 200 ends the processing. If it is confirmed that the power switch is not turned off (Step S601: N), the CPU 200 obtains the dew point temperature (Step S602). For example, the CPU 200 refers to the dew point temperature table stored in the ROM 201 to obtain the dew point temperature which corresponds to the outside air temperature and the outside air humidity obtained from the temperature and humidity sensor 180.

The CPU 200 determines whether the optical temperature obtained from the optical unit temperature sensor 181 is equal to or lower than the dew point temperature or not (Step S603). If it is determined that the optical temperature is equal to or lower than the dew point temperature (Step S603: Y), the CPU 200 determines that there is a possibility that the dew condensation occurs (or a condition of occurrence of dew condensation is satisfied) on the surfaces of the dustproof glasses 135*a* to 135*d*. In this case, the CPU 200 performs dew condensation recovery processing which will be described later (Step S610). If it is determined that the optical temperature exceeds the dew point temperature (Step S603: N), or after the dew condensation recovery processing is performed, the CPU 200 determines whether the print information is obtained or not (Step S604). If it is determined that the print information is not obtained (Step S604: N), the CPU 200 performs the processing after the step S601.

If it is determined that the print information is obtained (Step S604: Y), the CPU 200 stores the print information in the RAM 202 (Step S605). Thereafter, the CPU 200 performs the processing while reading the print information from the RAM 202 as necessary. The CPU 200 feeds the sheet P from the sheet feeding cassette 100 for printing and forms (prints) an image on the sheet P (Steps S606, S607). The CPU 200 discharges the sheet P having the image formed thereon to the sheet discharge tray 160 (Step S608). The CPU 200 determines whether to continue the image forming processing (printing processing) or not by the print information stored in the RAM 202 (Step S609). If it is determined not to continue the printing processing (Step S609: N), the CPU 200 performs the processing after the step S601. If it is determined to continue the printing processing (Step S609: Y), the CPU 200 repeatedly performs the processing after the step S606 until all pages to be printed are printed.

Figure 7:
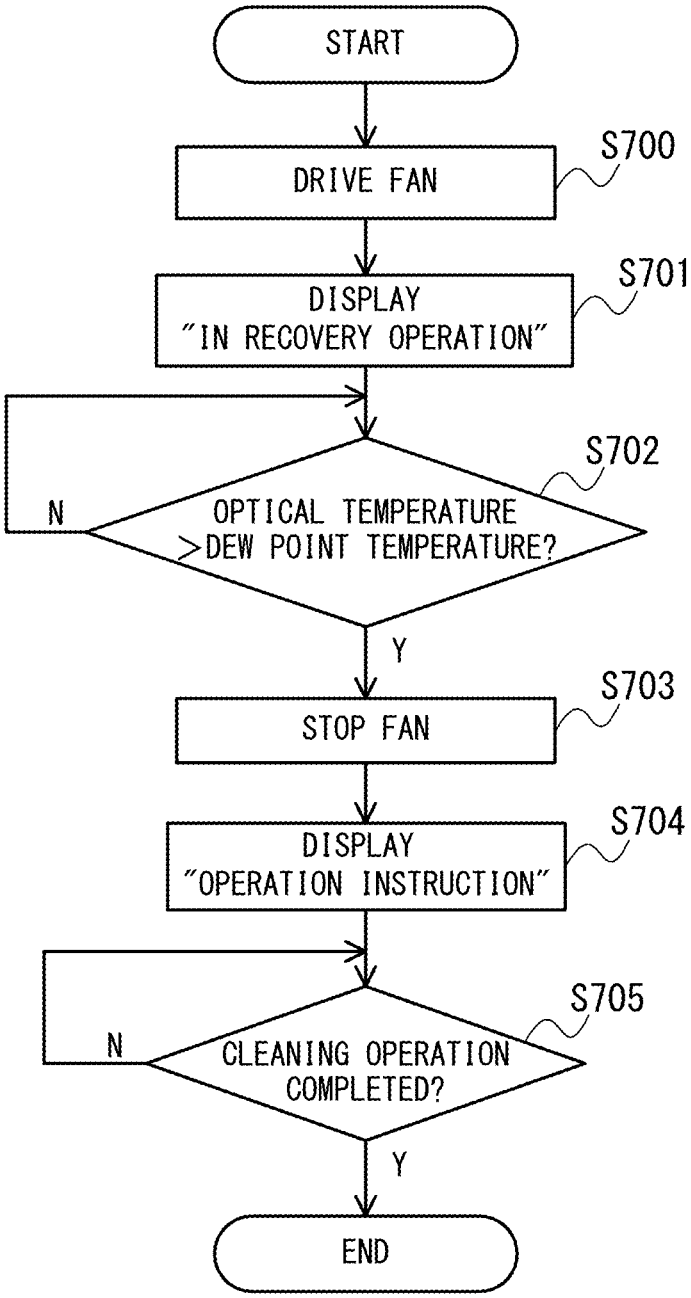
FIG. 7 is a flow chart showing dew condensation recovery processing.

FIG. 7 is a flow chart showing the dew condensation recovery processing of the step S610. The CPU 200 performs a recovery operation to increase the temperature inside the image forming apparatus 1 by the dew condensation recovery processing. Thereafter, the CPU 200 outputs an instruction to cause the user to clean the dustproof glasses 135*a* to 135*d*.

The CPU 200 drives the fan 182 to take the outside air inside the image forming apparatus 1 if the optical temperature is equal to or lower than the dew point temperature (Step S700). It should be noted that, at this point, the optical temperature is equal to or lower than the dew point temperature so that the outside air temperature is higher than the optical temperature. By driving the fan 182 to take the outside air inside the image forming apparatus 1, the temperature inside the image forming apparatus 1 increases, which accelerates the temperature increase on the surfaces of the dustproof glasses 135*a* to 135*d*.

The CPU 200 displays a message indicating that the recovery processing is being performed on the operation display part 170 after the fan 182 is started to drive (Step S701). FIG. 8A shows an example of this message. In the example shown in FIG. 8A, the message of "Glass inside the apparatus is dew-condensed and image may be distorted, so printing is prohibited. Recovery operation is currently being performed. Please wait for a little while more" is displayed on the operation display part 170.

The CPU 200 determines whether the optical temperature which is obtained from the optical unit temperature sensor 181 exceeds the dew point temperature or not after displaying the message (Step S702). If it is determined that the optical temperature does not exceed the dew point temperature (Step S702: N), the CPU 200 performs the processing of the step S702 until the optical temperature exceeds the dew point temperature.

If it is determined that the optical temperature exceeds the dew point temperature (Step S702: Y), the CPU 200 determines that there is a low possibility that the dew condensation occurs again (or possibility of satisfying a condition of occurrence of dew condensation is low) after cleaning the surfaces of the dustproof glasses 135*a* to 135*d* using the cleaning tool 300. In this case, the CPU 200 stops the fan 182 to finish the recovery operation (Step S703). After stopping the fan 182, the CPU 200 displays the message on the operation display part 170 instructing to clean the surfaces of the dustproof glasses 135*a* to 135*d* using the cleaning tool 300 (Step 704). FIG. 8B shows an example of this message. In the example shown in FIG. 8B, the message of "Recovery operation is completed. Please open a front door, wipe the glass inside the apparatus using the cleaning tool and then, close the front door. Please press "Operation Completion" when the operation is completed" is displayed on the operation display part 170. In addition to the message, an "Operation Completion" button is displayed on the operation display part 170.

The CPU 200 confirms whether the cleaning operation is completed or not after the message is displayed (Step S705). This is performed, for example, by determining whether or not the CPU 200 obtains the instruction from the operation display part 170 indicating that the user presses the "Operation Completion" button shown in FIG. 8B. If it is confirmed that the cleaning operation is not completed (Step S705: N), the CPU 200 waits until the operation completion is confirmed. If it is confirmed that the cleaning operation is completed (Step S705: Y), that is, if the user presses the "Operation Completion" button, the CPU 200 finishes the dew condensation recovery processing and performs the processing in the step S604 of FIG. 6.

As described above, in the image forming apparatus 1 according to the present embodiment, if there is a possibility that the dew condensation occurs on the surfaces of the dustproof glasses 135*a* to 135*d* provided in the optical unit 137, the fan 182 is driven to positively take the outside air inside the apparatus. The image forming apparatus 1 stops the fan 182 at a stage where the optical temperature exceeds the dew point temperature, that is, a stage where the optical temperature increases to a temperature at which the dew condensation does not occur. Then, the image forming apparatus 1 instructs the user to clean the dustproof glasses 135*a* to 135*d*. The image forming apparatus 1 displays the message on the operation display part 170 instructing to clean the dustproof glasses 135*a* to 135*d*, which allows the user to know in advance that the dustproof glasses 135*a* to 135*d* need to be cleaned. In accordance with this instruction, the user cleans the surfaces of the dustproof glasses 135*a* to 135*d* using the cleaning tool 300 to remove the dew condensation. By removing the dew condensation, the occurrence of the abnormal image during the image formation is prevented. This prevents any wasteful consumption of resources such as the sheet P, the toner, and the like caused by the occurrence of the abnormal image. Since the optical temperature exceeds the dew point temperature when the image forming apparatus 1 instructs the user to clean the dustproof glass, the dew condensation does not occur again on the surfaces of the dustproof glasses 135*a* to 135*d*. Thus, the occurrence of the dew condensation again after removing the dew condensation by cleaning the surfaces of the dustproof glasses is prevented, which prevents the occurrence of the abnormal image during the image formation.

As described above, in the present embodiment, if there is a possibility that the dew condensation occurs on the surfaces of the dustproof glasses 135*a* to 135*d*, the outside air is taken into the image forming apparatus 1. Then, after the possibility of occurrence of the dew condensation becomes low, the surfaces of the dustproof glasses 135*a* to 135*d* are cleaned. It means that the image forming apparatus 1 instructs to clean the surfaces of the dustproof glasses 135*a* to 135*d* after the optical temperature is adjusted. Not limited to his, for example, if there is a possibility that the dew condensation occurs on the surfaces of the dustproof glasses 135*a* to 135*d*, the image forming apparatus 1 may instruct to clean the surfaces of the dustproof glasses 135*a* to 135*d* without adjusting the optical temperature.

In determining whether there is a possibility that the dew condensation occurs on the surfaces of the dustproof glasses 135*a* to 135*d*, it is not limited to the method of determining whether the optical temperature is equal to or lower than the dew point temperature. For example, if a temperature difference between the optical temperature and the outside air temperature is equal to or greater than a predetermined value, the image forming apparatus 1 may determine that there is a possibility of occurrence of the dew condensation. In addition to driving the fan 182 to take the outside air inside the image forming apparatus 1, the optical temperature may be increased by, for example, providing a heater near the optical unit 137 to heat by the heater. By heating by the heater, the temperature inside the image forming apparatus 1 increases and the optical temperature increases. The possibility of occurrence of the dew condensation again after the cleaning is determined by determining whether the optical temperature exceeds the dew point temperature or not. In addition to this, the possibility of occurrence of the dew condensation again may be determined by, for example, a lapse of a predetermined time after the optical temperature is started to increase. For example, by driving the fan 182 for a predetermined time, the image forming apparatus 1 may determine that the possibility of occurrence of the dew condensation again is low.

The cleaning of the dustproof glasses 135*a* to 135*d* is performed by the user using the cleaning tool 300. In addition to this, the cleaning may be performed, for example, by a mechanism, through which the surfaces of the dustproof glasses 135*a* to 1353*d* are cleaned by the movement of the cleaning tool 300 with the insertion and extraction operation of the image forming parts 132*a* to 132*d*. In this case, for example, the cleaning tool 300 is attached to a face facing the dustproof glasses 135*a* to 135*d* of the image forming parts 132*a* to 132*d*. The image forming apparatus 1 displays the message on the operation display part 170 for instructing to clean the surfaces of the dustproof glasses 135*a* to 135*d* by inserting and extracting the image forming parts 132*a* to 132*d*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-115169, filed Jun. 18, 2018 which is hereby incorporated by reference herein in its entirety.

What is claimed is:

1. An image forming apparatus comprising:

a photosensitive member;

an optical unit, having a light source, configured to form an image on the photosensitive member by irradiating the photosensitive member with light emitted from the light source;

a light transmitting member through which the light from the optical unit is irradiated to the photosensitive member;

a cleaning member configured to clean a surface of the light transmitting member;

a determination unit configured to determine whether a condition of occurrence of dew condensation of the light transmitting member is satisfied or not; and a control unit configured to display a message on a display unit instructing to clean the light transmitting member with use of the cleaning member in a case where it is determined, by the determination unit, that the condition of occurrence of dew condensation of the light transmitting member is satisfied.

2. The image forming apparatus according to claim 1, further comprising:

a first temperature detection unit configured to detect an outside air temperature;

a humidity detection unit configured to detect an outside air humidity; and a second temperature detection unit configured to detect an ambient temperature of the optical unit, wherein the determination unit is configured to:

obtain a dew point temperature from the outside air temperature and the ambient temperature; and determine that the condition of occurrence of dew condensation is satisfied in a case where the ambient temperature is lower than a dew point temperature.

3. The image forming apparatus according to claim 1, further comprising:

a first temperature detection unit configured to detect an outside air temperature; and a second temperature detection unit configured to detect an ambient temperature of the optical unit, wherein the determination unit is configured to determine that the condition of occurrence of dew condensation is satisfied in a case where a temperature difference between the outside air temperature and the ambient air temperature is equal to or greater than a predetermined value.

4. The image forming apparatus according to claim 1, wherein the control unit is configured to, in a case where it is determined by the determination unit that the condition of occurrence of dew condensation is satisfied, perform a recovery operation to increase a temperature inside the image forming apparatus and display the message on the display unit after the recovery operation.

5. The image forming apparatus according to claim 4, further comprising a fan configured to take outside air inside the image forming apparatus, wherein the control unit is configured to perform the recovery operation by driving the fan to take the outside air inside the image forming apparatus.

6. The image forming apparatus according to claim 4, further comprising:

a heater configured to heat inside of the image forming apparatus, and wherein the control unit is further configured to perform the recovery operation by heating by the heater.

7. The image forming apparatus according to claim 4, wherein the determination unit is configured to determine that the condition of occurrence of dew condensation of the light transmitting member is not satisfied in a case where the ambient temperature of the optical unit exceeds, by the recovery operation, a temperature at which the condition of occurrence of dew condensation is not satisfied.

8. The image forming apparatus according to claim 4, wherein the determination unit is configured to determine that the condition of occurrence of dew condensation of the light transmitting member is not satisfied by a lapse of a predetermined time after the recovery operation is performed.

9. The image forming apparatus according to claim 7, wherein the control unit is configured to display the message on the display unit in a case where the determination unit determines that the condition of occurrence of dew condensation of the light transmitting member is satisfied and thereafter determines, by the recovery operation, that the condition of occurrence of dew condensation of the light transmitting member is not satisfied.

10. The image forming apparatus according to claim 1, further comprising:

a cartridge member configured to be inserted to and extracted from the image forming apparatus, and wherein the cleaning member is configured to clean a surface of the light transmitting member in conjunction with insertion and extraction of the cartridge member.

11. The image forming apparatus according to claim 10, wherein the cleaning member is attached to a face facing the surface of the light transmitting member of the cartridge member.

12. The image forming apparatus according to claim 10, wherein the cartridge member comprises the photosensitive member.

13. The image forming apparatus according to claim 1, wherein the light transmitting member is provided at a portion at which the light of the optical unit is emitted.

14. A method performed by an image forming apparatus, the image forming apparatus comprising:

a photosensitive member, an optical unit, having a light source, configured to form an image on the photosensitive member by irradiating the photosensitive member with light emitted from the light source, a light transmitting member through which the light from the optical unit is irradiated to the photosensitive member, and a cleaning member configured to clean a surface of the light transmitting member, the method comprising:

determining whether a condition of occurrence of dew condensation of the light transmitting member is satisfied or not; and displaying a message on a display unit instructing to clean the light transmitting member with use of the cleaning member in a case where it is determined that the condition of occurrence of dew condensation of the light transmitting member is satisfied.

* * * * *